United States Patent [19]

Kobayashi

[11] Patent Number: 4,466,645

[45] Date of Patent: Aug. 21, 1984

[54] AUTOMOBILE DOOR LATCH STRIKER

[75] Inventor: Fumio Kobayashi, Ayase, Japan

[73] Assignee: Ohi Seisakusho Co., Ltd., Yokohama, Japan

[21] Appl. No.: 360,243

[22] Filed: Mar. 22, 1982

[51] Int. Cl.[3] ..... E05C 13/00

[52] U.S. Cl. ..... 292/341.12; 292/216

[58] Field of Search ..... 292/340, 216, 341.12, 292/DIG. 56, 341.13

[56] References Cited

U.S. PATENT DOCUMENTS

| | | | |
|---|---|---|---|
| 1,620,414 | 3/1927 | Vanderlip | 292/91 X |
| 2,860,905 | 11/1958 | Wiese | 292/341.12 |
| 3,705,738 | 12/1972 | Yoshimura | 292/341.12 |
| 4,073,519 | 2/1978 | Kuroyu et al. | 292/DIG. 56 X |
| 4,165,112 | 8/1979 | Kleefeldt | 292/341.12 X |
| 4,357,039 | 11/1982 | Tölle | 292/341.12 |

*Primary Examiner*—Richard E. Moore

*Attorney, Agent, or Firm*—Zarley, McKee, Thomte, Voorhees & Sease

[57] ABSTRACT

An automobile door latch striker, integrally mounted to an automobile body for keeping an automobile door closed by engaging with a door latch provided on the automobile door and releasing the door by disengaging from the door latch. The striker includes a U-shaped rod 2 and the outer periphery of its intermediate portion is covered with mold-formed plastic material 5. Owing to the existence of this plastic material 5 better noise reduction and smooth and secure engagement becomes possible when engaging the striker with the door latch.

2 Claims, 5 Drawing Figures

AUTOMOBILE DOOR LATCH STRIKER

Technical Field

This invention relates to an automobile door latch striker, integrally mounted to an automobile body for keeping an automobile door closed by engaging with a door latch provided on the automobile door and releasing the door by disengaging from the door latch, and in particular to such a striker having a U-shaped rod which can be engaged with a latch piece of the door latch.

BACKGROUND ART

An automobile door latch striker having a U-shaped rod is known and, for example, disclosed in Japanese Utility Model Publication No. 56-3492.

However, conventionally, strikers of this type have been almost exclusively made of metal and have suffered the shortcomings of causing metallic impact and friction noises when engaging with door latches, causing uneven contact with a latch or a guide piece, or causing plays in the engagement between the stiker and the door latch, when it is not precisely manufactured, thereby impairing durability as a result of wear and breakage and causing annoying noises.

DISCLOSURE OF INVENTION

The primary object of this invention is to provide an automobile door latch striker which is free from the above-mentioned shortcomings.

Specifically, the primary object of this invention is to provide a door latch striker for an automobile which generates little noise and can allow smooth and secure engagement with a door latch when it is pushed thereinto.

According to this invention, such an object is accomplished by providing an automobile door latch striker, integrally mounted to an automobile body for keeping an automobile door closed by engaging with a door latch provided on the automobile door and releasing the door by disengaging from the door latch, characterized by that the striker comprises a freely standing rod which is integrally attached to a base plate fixed to an automobile body, and at least part of the rod which is adapted to be directly engaged with the latch piece of the door latch is covered with mold-formed elastomer.

According to the present invention, the rod is shaped as letter U so that its intermediate portion can engage with the door latch while its two ends are thermally rivetted to the base plate in a perpendicular relation and the intermediate portion in exclusion of the vicinity of the two end portions is covered with mold-formed elastomer.

Other objects, characteristics and advantages of this invention will become more apparent from the following description of a specific embodiment with references made to the appended drawings.

BEST MODE FOR CARRYING OUT THE INVENTION

Numeral 1 denotes a base plate which is provided with an upward bulge 1*a* at its center and a countersunk mounting hole 1*b* at each side thereof.

Numeral 2 denotes a metallic rod which has a horizontal portion 2*a* press-formed into a slightly flattened shape and columnar legs 2*b* and 2*c* bent from the horizontal portion 2*a* at a 90 degree angle, and is generally U-shaped.

The free end of each of the legs 2*b* and 2*c* is fit into a hole 3 provided at each side end of the upward bulge 1*a* of the base plate 1 and integrally secured thereto by thermal rivetting so that both of the legs 2*b* and 2*c* form a 90 degree angle with respect to the base plate 1.

The horizontal portion 2*a* and the upper portions of the legs, in exclusion of the free ends thereof in the vicinity of the base plate 1, are covered with a mold-formed elastomer layer 5 which is made of 66 nylon, urethane rubber or other synthetic elastomer or rubber.

Figure 1:
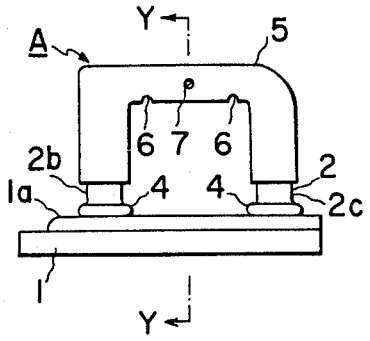
FIG. 1 is a front view of an embodiment according to this invention.
Figure 2:
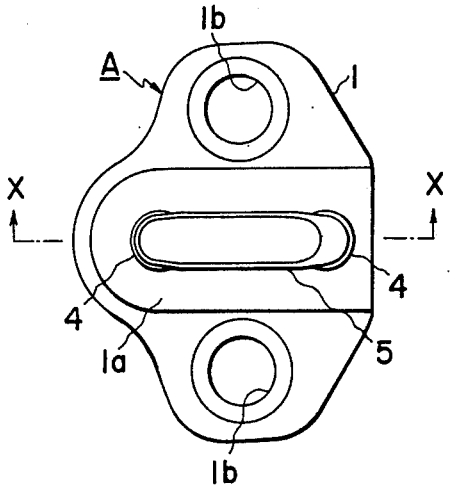
FIG. 2 is a plan view of the embodiment of FIG. 1.
Figure 3:
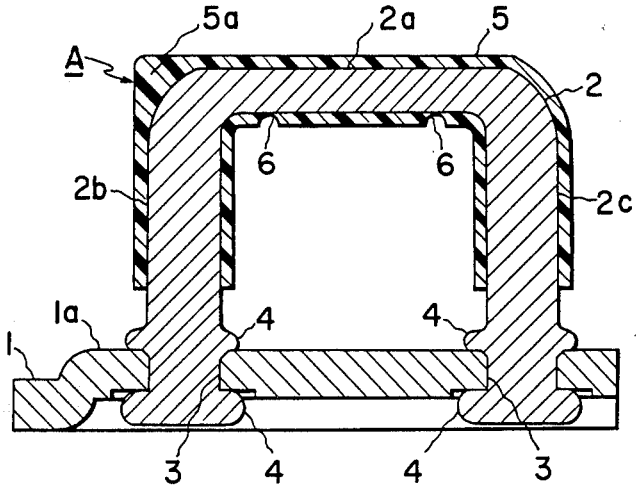
FIG. 3 is an expanded longitudinal sectional view taken along line X—X of FIG. 2.
Figure 4:
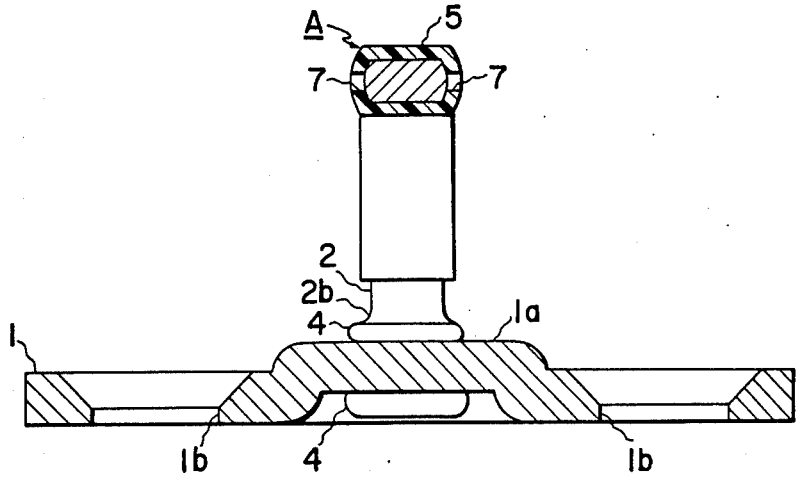
FIG. 4 is an expanded longitudinal sectional side view taken along line Y—Y of FIG. 1.

The thickness of the elastomer layer 5 is made to be uniform except for at the corner intersected by the leg 2*b* which is to be pushed into a door latch (See FIG. 5) ahead of the other leg 2*a* and the horizontal portion 2*a* where the elastomer layer is made relatively thicker into a thickened portion 5*a* so that one of the side ends of the rod which enters the door latch ahead of the other presents a columnar shape in spite of a certain curvature at the corner. The thickened portion 5*a* of the leastomer layer 5 is made to be substantially columnar on exterior in this embodiment as can be seen in the plan view of FIG. 2 but may be made into a prismatic shape with a square cross-section in external appearance.

Numeral 6 denotes a groove with a semi-circular cross-section extending across the lower surface of the horizontal portion 2*a* of the rod 2 at each of the positions symmetric to each other about the center while numeral 7 denotes a hole provided in each side of the elastomer layer 5 at the center of the rod 2 extending to the surface of the horizontal portion 2*a* of the rod 2 itself. These grooves and holes were made by positioning pins (which are not shown in the drawings) for positioning a split mold (which is also not shown in the drawings) relative to the rod 2 when mold-forming the elastomer layer 5 over the rod 2.

The striker A is thus comprised of the base plate 1, the rod 2 and the elastomer layer 5.

For the manufacture of a striker A constructed as described above, a straight rod is bent into the rod 2, a split mold for mold-forming is, after being opened up, closed over the rod 2 so that the lower surface and the both side surfaces of the central portion of the rod 2 are congruous to the positioning pins, elastomer material is injected into the mold, and then the free ends of the rod 2 is attached to the base plate 1 by rivetting at the parts 4 with the aid of heat.

Alternatively, after attaching the free ends of the rod 2 to the base plate 1 by rivetting at the parts 4, the elastomer layer may be molded over the intermediate portion of the rod 2 in exclusion of the free ends thereof.

Figure 5:
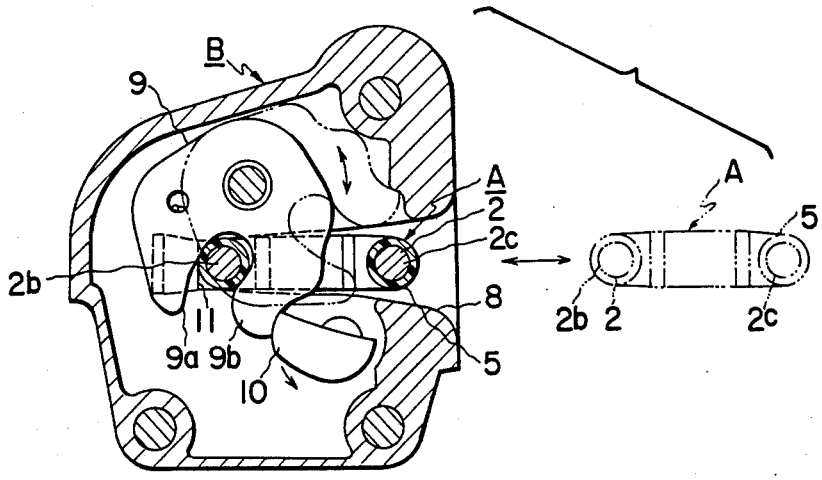
FIG. 5 is a longitudinal sectional view of essential part showing the manner of the actual use of the striker according to this invention with the engaged state of the striker and the door latch shown in solid lines and the disengaged state of the same shown in imaginary lines.

The striker contructed as described above according to this invention may be mounted on an appropriate place of an automobile body using appropriate fastening bolts (which are not shown in the drawings) and serve itself for engagement and disengagement to and from a door latch B, for example, as shown in FIG. 5 attached to a free end of an automobile door when the door is closed and opened.

In other words, as the door is closed, the striker A enters the door latch B sliding over the internal surface of a guide groove 8 provided in the door latch B with the leg 2*b* of the rod 2 engaging with the prong 9*b* of a latch piece 9 which is pivotally mounted on the door latch until one of the pieces 9*b* of the prong 9*a* of the latch piece 9 goes over the engagement pawl 10 pivotally mounted to the door latch B, thereby latching the door. When the door is thus latched, the leg 2*b* abutts to a stopper 11 made of rubber or the like and integrally attached to the door latch B.

When the door is being thus latched, the striker A according to this invention, which is covered with the elastomer layer 5 made of soft synthetic plastics or rubber at appropriate part, slides over the internal surface of the guide groove 8 and abutts to the stopper 11 without emitting any annoying impact or friction noises.

Since the elastomer layer 5 is made thicker at the corner between the horizontal portion 2*a* and the leg 2*b* of the rod 2 so as to form a columnar shape, the striker A can make even contact with the stopper 11, thereby enhancing the durability of the striker A and the stopper 11.

When opening the door, an inside handle or an outside handle (which is not shown in the drawings) is operated so as to turn the engagement pawl 10 until it is disengaged from the latch piece 9. When the engagement pawl 10 is completely disengaged from the holding of the latch piece 9, the striker A is pulled out from the latch as shown by the imaginary lines in FIG. 5 as is well known. Also, the latch is moved into the state as shown by the imaginary lines in FIG. 5 when the striker A is pulled out from the latch piece 9.

As can be clearly seen from the above description, the striker according to the present invention is highly convenient in preventing any annoying noises when closing and opening the door and making the engagement between the striker and the door latch both smooth and secure.

Furthermore, according to a conventional door striker made strictly of metal, when there is slight deformation in the rod, the contact between the striker and the latch piece and other parts of the door latch often becomes uneven, resulting in partial contact or increased friction thereby damaging the overall durability. On the other hand, according the striker of the present invention, any slight deformation in the rod is compensated in the molding process and satisfactory external contour of the rod can be easily and accurately obtained by virtue of the elastomer layer thereby preventing any partial contact, improving the durability, and eliminating the need for high precision in the manufacture of the rod.

I claim:

1. An automobile door latch striker, integrally mounted so an automobile body for keeping an automobile door closed by engaging with a door latch provided on the automobile door and releasing the door by disengaging from the door latch, characterized by that:

the striker comprises a U-shaped rod with a pair of spaced apart legs integrally interconnected by a horizontal portion, the legs being attached at their free ends to a base plate fixed to an automobile body;

one leg of the rod is adapted for engagement with the latch piece;

at least part of the rod which is adapted to be directly engaged with the latch piece of the door latch, in exclusion of both free ends thereof in the vicinity of the base plate, is covered with mold-formed elastomer;

and one leg of the rod which enters the door latch ahead of the other presents a columnar shape in spite of a certain curvature at the corner intersected by one of the legs of the rod which is to be pushed into the door latch ahead of the other leg and the horizontal portion of the rod.

2. The automobile door latch striker as claimed in claim 1, in which one of the legs of the rod which enters the door latch ahead of the other presents prismatic shape with a square cross-section in external appearance.

* * * * *